United States Patent [19]

Sohre

[11] 4,378,138

[45] Mar. 29, 1983

[54] SHAFT BRUSH FOR TURBOMACHINERY

[76] Inventor: Joachim S. Sohre, 1 Lakeview Cir., Ware, Mass. 01082

[21] Appl. No.: 174,264

[22] Filed: Jul. 31, 1980

[51] Int. Cl.[3] ..... H01R 39/40

[52] U.S. Cl. ..... 339/5 R; 339/6 R; 339/8R

[58] Field of Search ..... 339/5 R, 5 A, 5 M, 5 P, 339/5 RL, 5 S, 6 R, 6 A, 6 RL, 8 R, 8 A, 8 P, 8 PB, 8 PS, 8 RL

[56] References Cited

U.S. PATENT DOCUMENTS

| | | | |
|---|---|---|---|
| 1,145,926 | 7/1915 | Schweitzer | 339/5 R |
| 1,271,793 | 7/1918 | Stanley | 339/5 R |
| 2,269,614 | 1/1942 | Von Soden | 339/5 R |
| 2,342,936 | 2/1944 | Hansen et al. | 339/5 M |
| 2,548,631 | 4/1951 | Stapleton | 339/5 R |
| 3,013,143 | 12/1961 | Hayden | 339/5 S |

FOREIGN PATENT DOCUMENTS

| | | | |
|---|---|---|---|
| 456774 | 11/1936 | United Kingdom | 339/5 R |

*Primary Examiner*—John McQuade

[57] ABSTRACT

Destructive effects of shaft currents that are generated by residual magnetic fields in the stator or rotor are minimized by shaft grounding brushes that are positioned to contact a shaft surface and that are grounded externally of the machine. These brushes are desirably held by gravity against the shaft and with an indicator when maximum permissible wear has occurred on the brush.

23 Claims, 8 Drawing Figures

SHAFT BRUSH FOR TURBOMACHINERY

TECHNICAL FIELD

This invention relates to a device for removing shaft currents that are generated by residual magnetic fields in the stator or rotor of turbomachinery.

BACKGROUND ART

In the past several years, many unexplained failures have occurred in turbomachinery particularly in compressors, turbines, generators, pumps and the like in high performance, high speed installations. Such failures may be for example damage to bearings and bearing shoes and seals and where a spark jump may occur between rotating and stationary parts. This damage frequently results in destructive damage causing plant shutdown. This damage has been found in many cases to be the result of magnetic currents generated by residual magnetic fields in either stator or rotor components. The problem has become greater as magnetic tools become stronger and are more widely used both in manufacturing and repair. Much electric arc welding is now being done around these types of machines and currents created travel through casing and rotor leaving magnetic fields that may be very strong. When the machinery with these residual magnetic fields is put into operation and the rotor begins to turn electric voltages and currents are generated in the same manner as in an electric generator and the strength of these voltages and currents depends on the strength of the residual magnetic fields and their relationship to one another, the clearances and masses involved, the speed of the rotor, the available paths for the currents and insulated properties of the oil film. Self-excitation may occur as the currents and fields line up with the result of rapid failure of the machinery.

DISCLOSURE OF INVENTION

One feature of the invention is a grounding brush that may be positioned in or on the compressor, turbine or other machine to be held against the shaft and to provide for grounding the created electrical currents to a point outside the machine. Another feature is a weighted brush to maintain a constant pressure of the brush against the shaft. Another feature is a brush so arranged to insure long wear and continuous contact with the shaft.

Another feature is a thin housing that makes possible the positioning of a device in a relatively short axially distance in the machinery, for example, between the end of the compressor and the adjacent bearing, without significant modification of the housing of the machinery. A further feature is a brush mount that is readily removable from the housing without electrical contact between the brush mount and housing during removal and replacement. The device also incorporates an indicator for showing the extent of wear on the brush, and a switch for signalling when the maximum permissible wear has occurred.

According to the invention, a casing for the device is relatively flat and has an external attachment flange for securing the casing to the housing of the machine to which it will be mounted. The casing is adapted to extend into a relatively short axially space within the housing and normally at the end of a rotor and is positioned essentially horizontally and so as to extend substantially tangentially to a generally cylindrical surface on the rotor with which the brush engages. The brush support is made up of thin parallel plates supporting between them a brush arm on a pivot pin in said plates and these plates are secured to an end cap for attachment to the surrounding casing. The brush arm carries the brush removably at its inner end and is so constructed as to have a significant mass between the pivot point and the brush for holding a brush by gravity against the shaft. A ground wire from the brush conducts electrical current to an insulated contact by which to ground the brush externally of the machinery. A window in the cap permits visibility of the end of the brush arm for determining brush wear and a switch in a position to be engaged by the brush arm will indicate maximum permissible brush wear.

Other features and advantages of the invention may be seen by referring to the following description and claims, read in conjunction with the accompanying drawings.

DETAILED DESCRIPTION OF THE INVENTION

The device is constructed to be mounted on a housing 2 for a compressor or turbine and the device extends through a hole 4 in the housing in a direction substantially tangential to a cylindrical or conical surface 6 on the rotor, the brush 8 for the device resting on this surface as shown and the device itself being substantially horizontal, that is within about 45° from horizontal so long as to permit the gravity action on the brush as later described.

Figure 1:
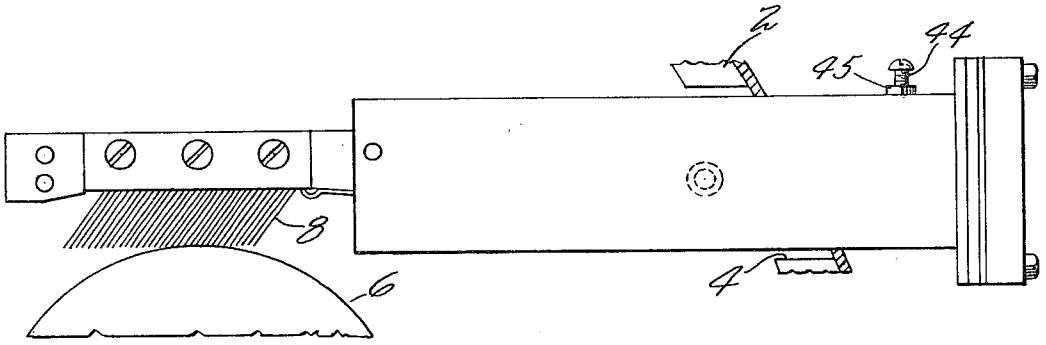
FIG. 1 is an elevation of the device.
Figure 3:
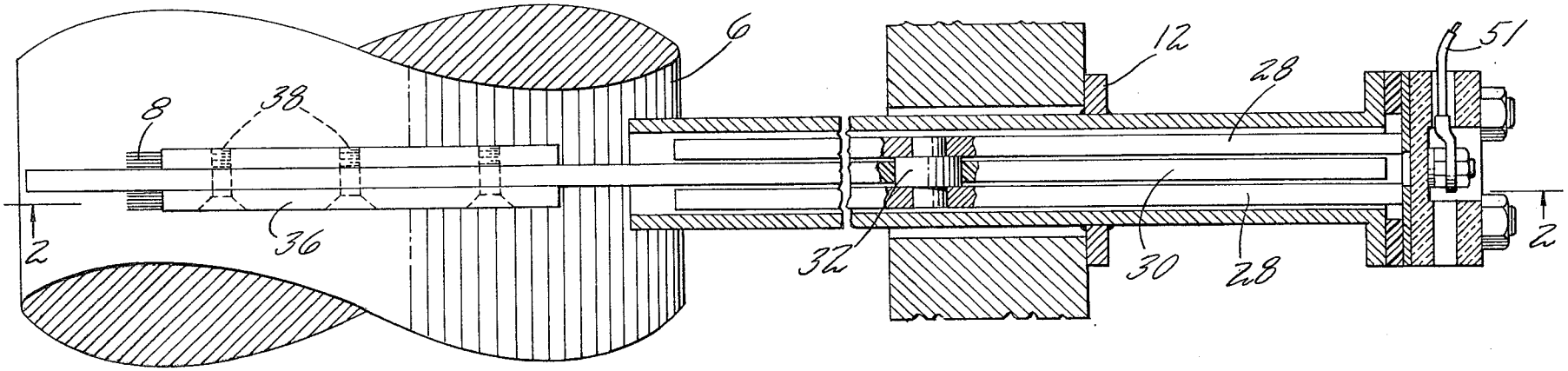
FIG. 3 is a horizontal sectional view along the line 3—3 of FIG. 2.
Figure 2:
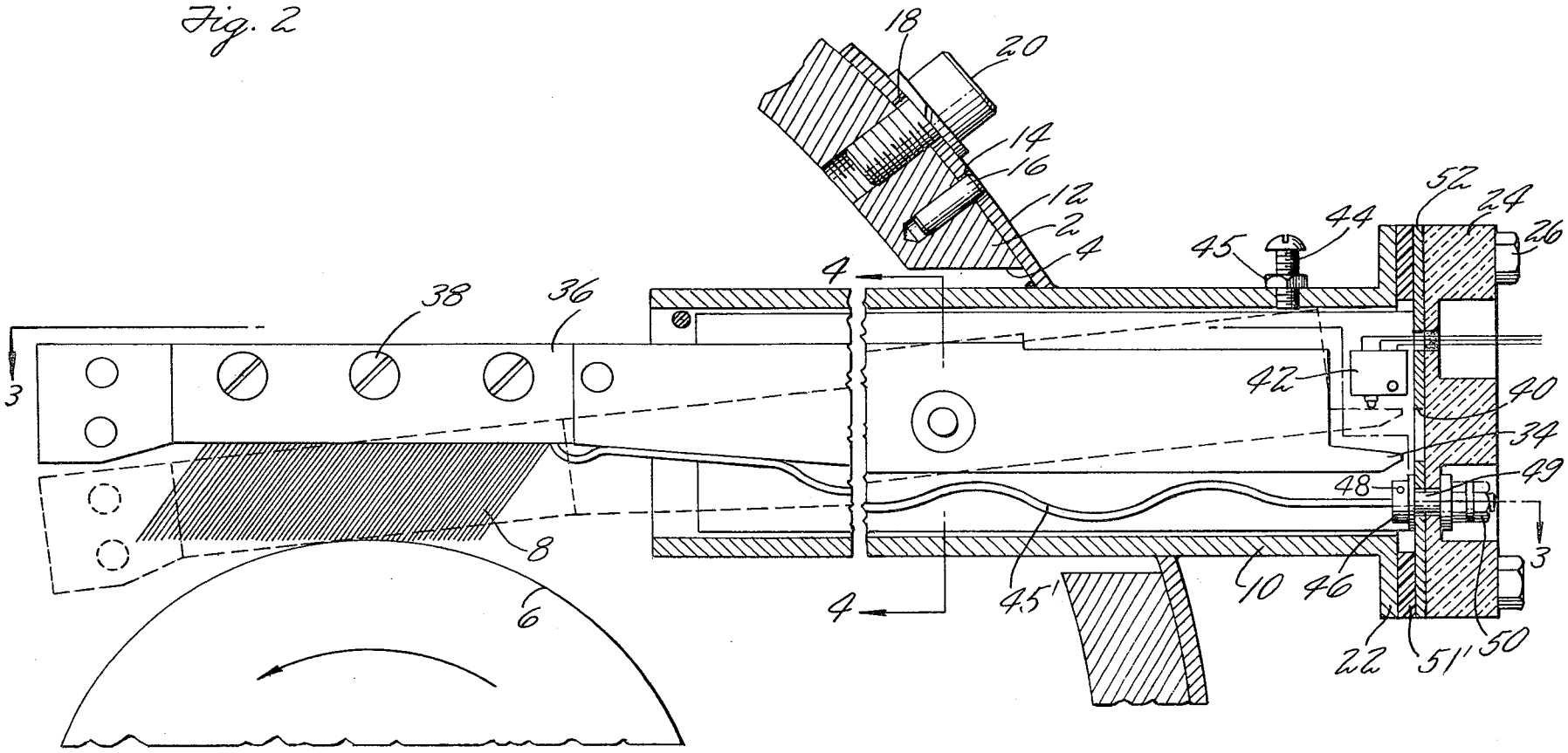
FIG. 2 is a vertical sectional view along line 2—2 of FIG. 3 through the device showing it installed.

The device has a thin, relatively flat substantially rectangular casing 10 with flat space sidewalls as shown in FIGS. 2 and 3. This casing is welded to a mounting flange 12 having a curvature to conform to housing 2 and having locating holes 14 for pins 16 in the housing and bolt holes 18 to receive attachment bolts 20. The casing has an end flange 22 as shown for attachment of the brush supporting structure.

Figure 4:
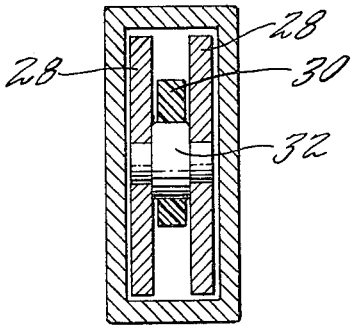
FIG. 4 is a vertical sectional view along the line 4—4 of FIG. 2.
Figure 6:
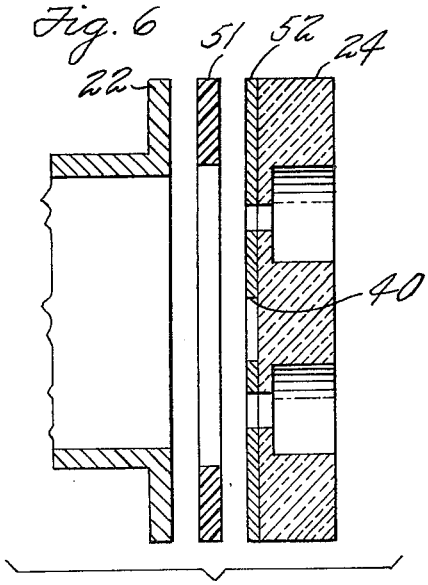
FIG. 6 is a view with the cap and attached liners partially removed from the device.
Figure 5:
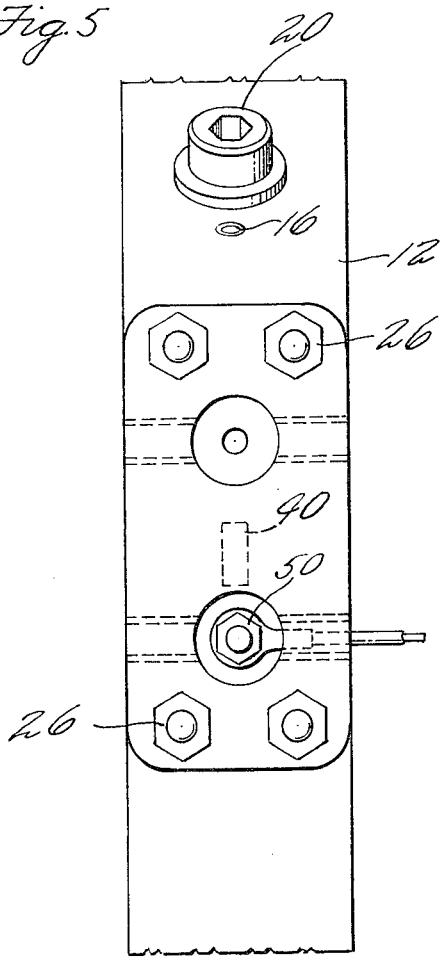
FIG. 5 is an end view of the device.

Within the casing is the support structure for the brush 8. A cap 24 adapted to be attached to the end flange by bolts 26 supports a pair of spaced liner plates 28 that are spaced inwardly from the casing sidewalls and are also spaced from the top and bottom walls as shown in FIGS. 2 and 4. These liner plates are a non-conducting, non-magnetic material such as Teflon®. The plates are spaced apart to receive the brush support arm 30 which is free to pivot on a pin 32 mounted in the liner plates. The arm 30 is a thin plate having a wear indicator 34 at the end that is close to the cap. The other end of the arm extends beyond the end of the casing and in overlapping relation to the rotor and supports the brush 8 in a position to engage the shaft.

The brush has a grooved backing 36 that fits over the end of the arm and is held thereon by a set of screws 38. The brush may be of any suitable conductive material, such as graphite, carbon, sponge or solid or the more conventional bristles. In the arrangement shown, the brush is made of bristles and these bristles are a highly conductive wire of a material that will have a low rate of wear. Desirably the bristles are positioned so as to extend at an acute angle to the line of tangency with the shaft and in the direction of shaft rotation, thereby to minimize wear on the bristles and also to minimize wear on the shaft surface while also maintaining continuous contact between the bristles and the shaft surface.

The brush is held against the shaft by the weight of the support arm. As shown, there is a significantly larger area of arm at the brush end of the arm, that is to the left of the pivot so that the weight of this portion of the arm will hold the brush with a constant pressure against the shaft. Additional weight may be added to the brush end of the arm, if desired, to load the brush higher.

At the other end, the wear indicator is visible through a transparent window 40 in the cap and as wear on the brush occurs the indicator moves upwardly past the window until the brush has a maximum permissible wear. At this time, the cap and liners carrying the brush arm and brush thereon may be removed from the casing for brush replacement.

To signal the need for brush replacement, the indicator on the brush arm may engage a switch 42 so positioned as to be actuated by the arm at the position of maximum allowable wear and to signal as by a suitable bell or light the need for brush replacement. When brush replacement is necessary, the brush may be withdrawn from contact with the shaft by a brush raising screw 44 positioned in the casing in a location to engage the brush arm as shown. Suitable spacer nuts 45 may lock the screw in inoperative or in brush raising position. The switch is positioned between and supported by the spaced plates.

The brush is electrically connected by a lead wire 45' to a terminal bar 46 supported at the cap by a pin 48 extending through the liner plates. This bar carries a terminal 49 that extends through and is insulated from the cap. This terminal has a clamping nut 50 on the end for attachment of a grounding connection 51. In this way, the brush has an electrical connection to a ground outside of and independent of the brush casing or the main housing and thus electrical currents developing in the shaft are conducted directly to an external ground.

In installing the device, the casing is positioned in the machine housing as shown with the casing substantially horizontal. Since the casing is thin as shown, it will be apparent that it may be installed within a relatively narrow space between successive compressor or turbine rotors on a shaft without interfering with the rotor blades and where the brush may engage the rotor with only a short axially length of the shaft accessible. In most installations, a structure made thin as shown in the drawing may be positioned in operative relation to the rotor and shaft with no further alteration of the machinery other than the making of the hole in the housing through which the casing extends.

When the casing has been bolted in position in the housing the cap and associated parts may be placed in operative relation on and within the casing. Since the liner plates and brush are nonconductive, there will be no electrical contact from the brush to any part of the casing or housing during the insertion of the brush and the brush arm and the supporting plates. After the parts are in position, the cap is bolted to the flange as shown. An insulating gasket 51' is positioned between the end cap and flange in the casing further to avoid electrical interconnection to the casing or housing. Between the gasket 51 and the cap 24 is also a plate 52 in which the window 40 is formed. The cap is preferably made of a transparent material as shown so that the indicator on the brush arm will be visible through the cap.

With the device in position, the brush is lowered into shaft contact by raising the brush controlling screw 44. With a new unworn brush in position the indicator will be in the full line position shown near the base of the window.

As wear on the brush occurs the wear indicator moves up as the brush moves down until the indicator arm on the brush actuates the switch or reaches a visual indicator on the window. The signal actuated by the switch will indicate a need for brush replacement. At this time the grounding lead is disconnected, and the brush is then raised by lowering the brush positioning screw 44 so that the brush will be out of contact with the shaft. The cap is then unbolted and the liner plates, brush arm and brush are removed from the casing with no possibility of electrical grounding with the casing or the housing. Once the brush is accessible, replacement of a brush on the brush arm is readily accomplished and the brush arm and liner plates supporting it with a new brush may again be placed within the casing and secured in place by bolting the cap in position.

Figure 7:
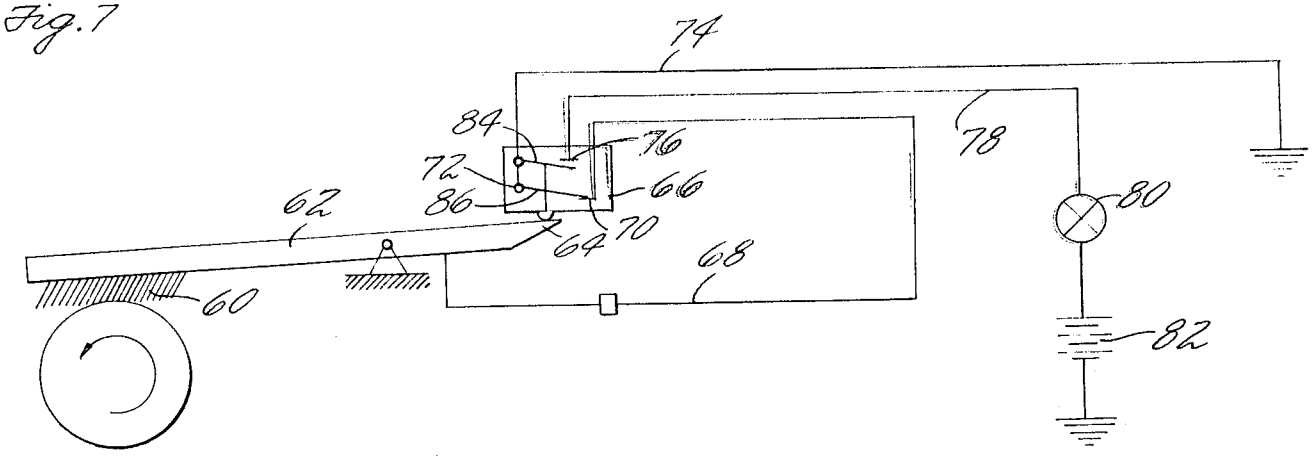
FIG. 7 is a diagrammatic showing of a modified grounding attachment.

It is essential that the grounding lead for the brush be disconnected before the brush is removed from contact with the shaft to prevent any sparking between the brush and the shaft as it is withdrawn. In the mechanism above described, the disconnection of the grounding lead must be done manually. It is desirable in many cases to have the grounding device disconnected from the brush automatically. This is accomplished by the arrangement shown in FIG. 7 in which the brush 60 on the brush arm 62 when worn moves the indicator arm 64 into contact with the switch 66 as in the arrangement above described. However, in this arrangement the switch is so arranged as to mechanically disconnect the ground when actuated by the arm 64. As shown, the grounding wire 68 from the brush goes to a terminal 70 in the switch and this terminal is normally in electrical connection with another terminal 72 which is grounded by a lead 74. Another contact 76 in the switch is connected by a lead 78 to another indicator such as a light 80 and through a battery 82 to ground. The contact 76 is engaged by a switch element 84 when the switch is actuated to indicate maximum brush wear and when this contact is made the light 80 is energized by the electrical source 82. At the same time the electrical connector 86 in the switch breaks the connection between the contact 70 and 72 so that the ground for the brush is disconnected from a brush by the actuation by the switch. It will be understood that this switch is positioned between the support plates for the brush arm and connected thereto to be retained in the proper position for engagement by the brush arm.

Figure 8:
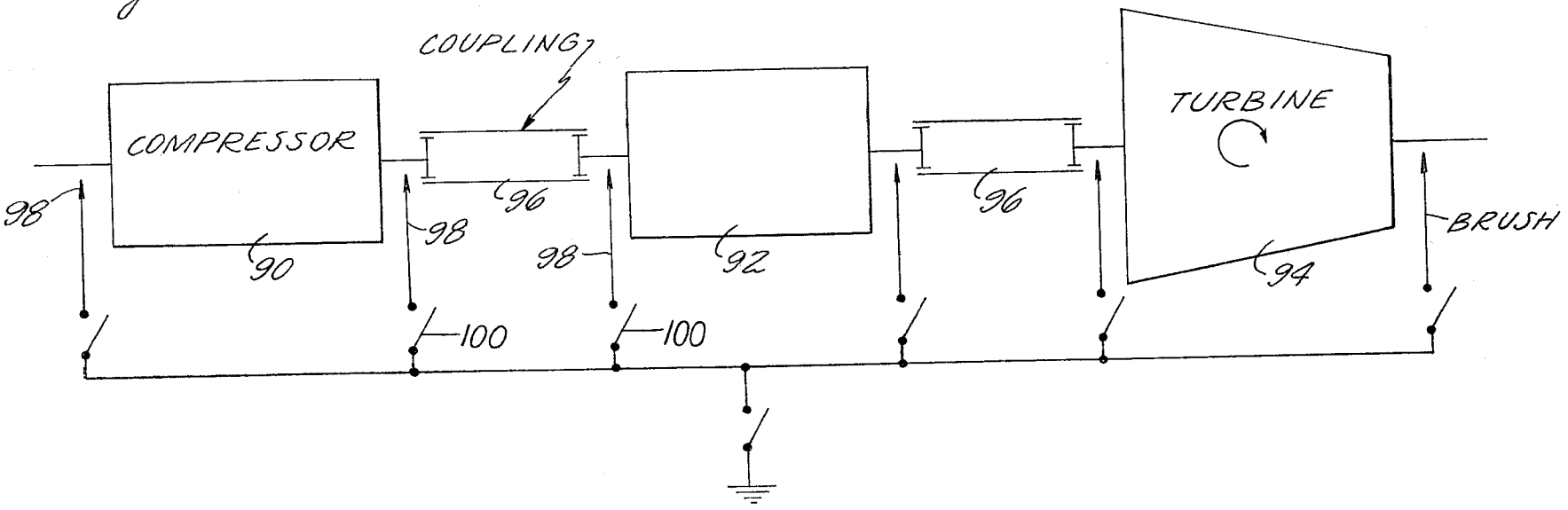
FIG. 8 is a diagrammatic view of a grounding system for the entire compressor turbine installation.

In a large compressor turbine installation as shown in FIG. 8 where there are two or more compressor housings 90 and 92 and one or more turbine housings 94, each having its associated rotor, and with the several rotors coupled together as at 96, a plurality of these grounding devices 98 are positioned as shown, desirably one at each end of each housing. Each of these devices is connected to a common ground by individual switches 100 all of which are normally closed, but any of which may be individually opened when necessary for servicing or testing the particular device with which that switch is associated. It is important to note that these devices serve to remove any electrical energy created in the rotors to an external ground outside of the machinery housing thereby minimizing or avoiding any energy buildup in the rotor and thereby in general preventing the electrical discharge within the machinery that might result in damage to seals, bearings or rotors with resultant required shutdown of the machinery.

With the arrangement as above described, the brush casing is insulated from the shaft voltage currents so that there is no spark or short hazard. The brush is grounded externally of the casing of the device and the housing for the machinery. The shaft voltages and currents can be measured with this device. As above stated, the device can be mounted within a short axially space and a very small shaft exposure less then one half inch is necessary. With the brush weighted against the shaft, the weight and thus the spring contact of the brush bristles can be adjusted to prevent brush jumping so that only one brush is needed for continuous grounding. By unbolting the cap the brush may be removed while the machinery in operation without the brush deflecting sideways to contact the rotor and without electrical contact with the brush casing. The structure above described with metallic bristles is adapted for use at a wide range of temperatures as high as 500° F. and as low as −70° F. for refrigeration or arctic service. With suitable materials, even higher temperatures are possible. Further, the construction permits effective use in either a dry or oil environment.

Since the brush, its mounting and the casing are nonmagnetic, inductive resistance is eliminated. The shaft circuits are of short duration and would generate inductive resistance if these parts were magnetic. Further, the brush assures good continuous contact at very low pressure from the brush arm and assures suitable continuous electrical contact. If the brush resistance were higher then the internal resistance in the machine, the currents would go to the machinery causing damage. Thus, it is essential that the electrical circuit to the brush through the external ground be lowest resistance circuit in the entire structure.

I wish it to be understood that I do not desire to be limited to the exact details of construction shown and described, for obvious modifications will occur to a person skilled in the art.

I claim:

1. A brush structure for removing electrical current from a turbomachinery shaft including:

a casing having an end flange, a brush support in said casing having an end cap engaging said end flange, a brush arm pivoted on said support, a brush mounted on one end of the arm to engage the shaft, and an attachment flange on said casing for attachment to the turbomachinery.

2. A brush structure as in claim 1 in which the brush support includes parallel plates of nonmetallic material spaced apart to receive the brush arm therebetween.

3. A brush structure as in claim 2 in which the casing is rectangular in cross section and the parallel plates are parallel to the longitudinal dimension of the rectangular shape.

4. A brush structure as in claim 1 in which the brush arm is heavier on the brush side of the pivot to use the weight of the arm for holding the brush against the shaft.

5. A brush structure as in claim 1 in which the brush has metallic bristles that extend at an acute angle with respect to the brush arm.

6. A brush structure as in claim 1 in which the brush has a backing that is grooved to fit over the brush arm and is removably secured thereto.

7. The combination with a turbomachine having a housing and a rotor within the housing with a short exposed substantial cylindrical surface of a brush device for removing electrical currents from the rotor, said device including:

a casing having a mounting flange thereon for attachment to said housing, there being an opening in said housing to receive the casing, a brush support including a pair of parallel support plates, a cap to which the plates are attached and which engages with the outer end of the casing, a brush arm pivotally supported between said plates and having an indicator thereon at the cap end, a brush mounted on said arm at the inner end and having metallic bristles thereon to engage said surface on the rotor, and means in the casing for pivoting the arm on its pivotal support to withdraw the brush from the shaft.

8. A combination as in claim 7 in which the mounting flange supports the casing in a substantially horizontal position with the brush on the arm substantially tangential to the surface on the rotor.

9. A combination as in claim 7 in which the casing is relatively flat in an axial direction and the parallel plates are of a size to prevent contact between the casing and the brush arm in removal of the brush and its support from the casing.

10. The combination as in claim 7 in which the casing has an end flange and the cap is removably secured to said end flange.

11. The combination as in claim 7 in which the cap has a window therein through which the indicator is visible.

12. A brush device including:

a relatively thin casing substantially rectangular in cross section and having a flange at one end, a brush mount fitting in said casing and including spaced parallel plates of nonconducting material, a cap to which said plates are secured, said cap being removably attached to said flange on the casing, a brush arm pivoted between said plates, the latter carrying a pivot pin on which the arm is mounted, a brush at the end of the arm remote from the cap, said brush having bristles extending at an acute angle to the brush arm, and means carried by said plates to engage a portion of the arm when a maximum wear has occurred on the brush.

13. A brush device as in claim 12 in which the cap has an electrical terminal therein and insulated therefrom, said terminal having an electrical connection with the brush.

14. A brush device as in claim 12 in which the means engaged by the arm include a switch supported by the plates and activated when the brush is worn to the permissible limit.

15. A brush device as in claim 12 in which the plates are substantially the dimension of the casing and with clearance on both longitudinal edges.

16. A brush device as in claim 12 in which the cap has a window therein through which a portion of the arm is visible to determine the extent of wear on the brush.

17. A brush device as in claim 14 which an electrical connection is made through the switch between the brush and terminal connected to an outside ground and this connection is broken when the switch is activated.

18. A brush device as in claim 14 in which the end of the arm remote from the brush is positioned to engage the switch.

19. A brush device as in claim 12 in which the arm has a greater mass between the pivot pin and the brush then at the other side of the pivot pin such that the brush is held in operative position by the weight of the arm.

20. A brush device as in claim 12 in which the casing carriers an adjusting screw in a position to engage the arm for placing the brush in an operative position.

21. A brush structure for removing electrical current from a rotary machinery shaft including:

a casing having an end flange and having means thereon for attachment to the machinery, a brush support in said casing including spaced parallel non-magnetic plates slidable in said casing, said support having an end cap engaging said end flange, a brush arm between said plates and movable relative thereto, a brush mounted on the end of the arm remote from the end cap and in a position to engage the machinery shaft, and means limiting the movement to the brush arm relative to the plates.

22. A brush structure as in claim 21 in which the structure is arranged such that the brush is urged into contact with the shaft by the weight of the arm.

23. A brush structure for use in rotary machinery having a housing and a shaft, said structure including:

a relatively thin casing substantially rectangular in cross section and having a mounting flange for attachment to the housing, a brush mounting including spaced parallel plates of non-conducting material fitting removably within the casing, a brush arm positioned between the plates and movable relative thereto, a brush on one end of the arm in a position to engage the shaft, and a cap on the outer end of the casing remote from the brush, the position of the device on the machinery being such that the brush is urged in a direction to engage the shaft by gravity.

* * * * *